United States Patent [19]

Altorfer et al.

[11] 4,269,867

[45] May 26, 1981

[54] METALLIZING OF A CORRODIBLE METAL WITH A PROTECTIVE METAL

[75] Inventors: Kenneth J. Altorfer, Greenwich, Conn.; Daniel R. Marantz, Port Washington, N.Y.

[73] Assignee: Texasgulf Inc., Stamford, Conn.

[21] Appl. No.: 72,117

[22] Filed: Sep. 4, 1979

[51] Int. Cl.[3] ..... B05D 1/02; B05B 5/06; C23C 7/00

[52] U.S. Cl. ..... 427/37; 219/76.14; 427/422; 427/423

[58] Field of Search ..... 118/620; 427/37, 34, 427/422, 423; 219/76.13, 76.14, 76.16

[56] References Cited

U.S. PATENT DOCUMENTS

| | | | |
|---|---|---|---|
| 1,221,104 | 4/1917 | Stolle | 427/422 |
| 1,769,363 | 7/1930 | Arvidson | 427/422 |
| 2,972,185 | 2/1961 | Brennan | 427/422 |
| 3,114,826 | 12/1963 | Sullivan et al. | 219/76.16 |
| 3,246,114 | 4/1966 | Matvay | 427/34 |
| 3,546,415 | 12/1970 | Marantz | 427/37 |
| 3,947,607 | 3/1976 | Gazzard et al. | 427/37 |

*Primary Examiner*—John H. Newsome
*Attorney, Agent, or Firm*—Denis A. Polyn

[57] ABSTRACT

An apparatus and method for spray metallizing a coating of metal (e.g. zinc) onto one or both sides of a base metal (e.g. steel) which comprises melting the metal to be deposited, propelling first and second streams of the melted metal towards the base metal at a point of convergence adjacent to the substrate, and applying a potential difference between the streams to form an electric arc whereby superheated particles are deposited on the base metal.

20 Claims, 3 Drawing Figures

METALLIZING OF A CORRODIBLE METAL WITH A PROTECTIVE METAL

BACKGROUND OF THE INVENTION

1. Field of the Invention

This invention relates to a method and apparatus for coating a corrodible base metal, on one or both sides, with another metal which is molten. More particularly, the invention relates to a method and apparatus for spray metallizing a coating of metal onto one side of the base metal, using an electric arc.

2. Description of the Prior Art

A number of processes are known for the production of sheet steel which is galvanized on one side. These include such conventional methods as the continuous passage of sheet metal through a bath of molten metal, and continuous thermal spraying. Commercial galvanized sheet in which zinc is coated on both sides is not generally acceptable for use in automobile body construction because of complications arising from the adherence of zinc to the tips of welding electrodes in resistance welding processes. Again, while it is desirable to have the zinc covering on interior surfaces where its protective qualities are most needed, it is desirable to leave the exterior surfaces uncoated to promote the adherence of paint or other surface finishes.

In the case of the thermal spraying process, the material being sprayed, in this case zinc, is supplied to "pot guns" in bulk form and heated to a temperature of approximately 426°–482° C., and atomized with a propellant such as air and sprayed onto the surface to be coated. In another version of this process, wire or powder is fed into an oxy-fueled flame which melts it and air atomizes and propels it onto the surface to be coated. Another thermal spray process, electric arc metallizing, which utilizes two metal wires fed to an electric arc, is described in U.S. Pat. No. 3,546,415, herein incorporated by reference.

These processes all suffer in one way or another from a variety of deficiencies. For instance, the processes which utilize zinc wire or powder are much more expensive than those which use slab zinc, since there is a price differential of over 50% between the two forms of this material. When wire is used, in addition there is a loss due to overspray which can amount to as much as 30 to 40% of the material, leaving a net deposit efficiency of 60 to 65% of material which actually sticks to the metal surface. Galvanizing by hot dipping has several deficiencies. First, the iron-zinc, metallurgical bond, which is formed at the interface between the metals in the form of a crystalline surface, leaves a structure which is brittle and is undesirable for automobile parts, since it cannot be deep drawn; however, other techniques are available to reduce the brittleness of the coating. Another disadvantage of galvanizing is that large open vats are required to accommodate the customary widths of the sheet steel. A great deal of energy is wasted in maintaining the baths at 426° C. or so, to keep the zinc in the molten state. The disadvantage of "pot gun" process is poor quality of coating and low deposit efficiency.

It is an object of the present invention to provide a method and apparatus for the continuous spray metallizing of sheet steel with molten zinc, which utilizes slab zinc, is economic in its heat requirements, and in which there is little waste material.

SUMMARY OF THE INVENTION

The above objects and others which will become apparent from the below appended specification are achieved by the present invention in which the metal which is to form a coating on a substrate is melted in two electrically isolated, heated containers. Molten metal is drawn from each container and conveyed, under pressure, through thermally and electrically insulated pipes, to a coating head. The coating head consists of one or more pairs of nozzles by means of which the two streams of molten zinc are projected and caused to meet at an intersection. The contents of the individual heated containers are connected to either pole of a DC electric power source and electric arc of high intensity is formed where the two jet streams meet superheating the streams of molten metal. The coating metal, in a superheated state, is propelled by a gas onto the surface of the sheet to be coated. It is a distinctive feature of the present invention that, when, for example, slab zinc, the cheapest form of commercially available zinc, is used in conjunction with an electric arc, which has the most economic operation costs, a sprayed zinc coating is produced which is of high quality and, at the same time, is extremely economical.

DETAILED DESCRIPTION OF THE INVENTION

Figure 1:
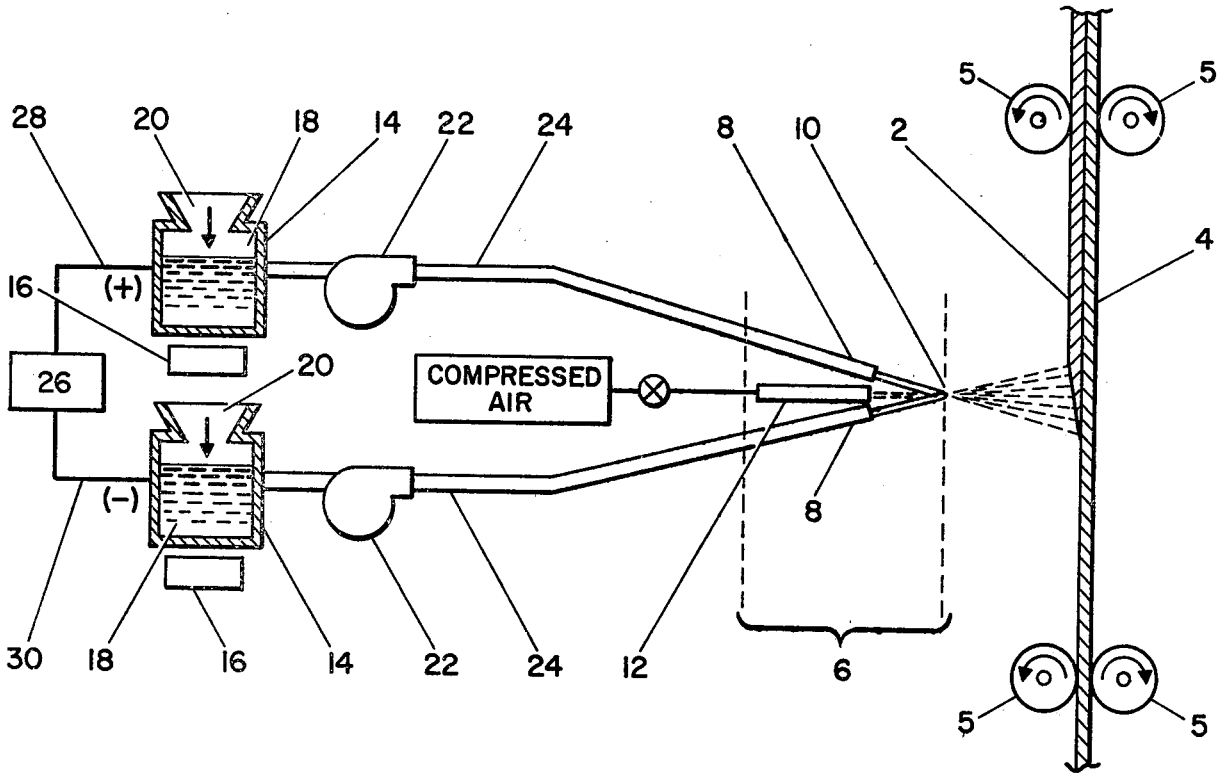
FIG. 1 is a schematic diagram illustrating an apparatus useful in carrying out the invention.

Reference is now made to FIG. 1, in which a simplified schematic representation of an apparatus for applying a coating of metal to the surface of moving substrate is shown. In the description which follows, as in the drawings, supporting structure which would be conventionally supplied has been omitted in the interest of simplicity of presentation. It will therefore be understood that a substrate 4, which is being coated, is moved past a zone in front of coating head 6, by means of a conventional apparatus having rollers 5, in such a way that superheated metallic particles generated by coating head 6 are propelled onto the surface of substrate 4 where they unite and congeal to form a solid coating. Coating head 6, which is shown in more detail in FIGS. 2 and 3, has a pair of nozzles 8 which cause two pumped streams of molten metal, such as zinc, aluminum, nickel, stainless steel, or various alloys, such as, for example, 85% zinc-15% aluminum or 95% zinc-5% aluminum, to converge at an included angle of approximately 30°. Molten metal traveling in jets to the point of convergence 10 is further propelled by a stream of gas, usually air, supplied at high velocity by nozzle 12 which is, conveniently, centrally placed between nozzles 8 and aimed at point of convergence 10. It should be noted that different metals can be simultaneously used in each of the electrically isolated containers 20.

Molten metal is supplied to each nozzle 8 from individual containers 14. For the sake of illustrative simplicity, containers 14 are simple tanks, shown heated by burners 16, for maintaining slab zinc supplied through hoppers 20 in molten pools 18. It will be understood by those skilled in the art that any of a large variety of pots may be used for this purpose, such as a ceramic coated steel pot, a graphite crucible, or any other suitable type of container which can melt slab zinc at a rate appropriate to supply the necessary molten zinc to the moving substrate at a rate appropriate to the desired thickness.

For the sake of simplicity, the illustrative embodiment of FIG. 1 shows pumps 22 for moving the liquid metal from containers 14 to nozzle 8. It will be understood by those skilled in the art that conventional centrifugal liquid metal pumps 22 may be used for this purpose; in the alternative, gravity or pressure feed can also be used. Similarly, conduits 24 can be thermally insulated, electrically nonconductive pipe of a conventional nature. A DC power source 26 is connected to the liquid supply system just described by conductors 28 and 30, each of which is connected, within its respective container 14, to the liquid metal pool 18 contained therein. DC power source 26 may be either a motor generator, a transformer and rectifier, or simply, DC batteries. Power source 26 should preferably be adjustable to a voltage between 15 and 30 volts, and have electrical response characteristics of the constant voltage type. It should be noted that the instant invention can be practiced with only one container for holding the molten metal to be sprayed, in which case one of the nozzles 8 would be replaced by a non-consumable electrode (e.g. graphite).

Figure 2:
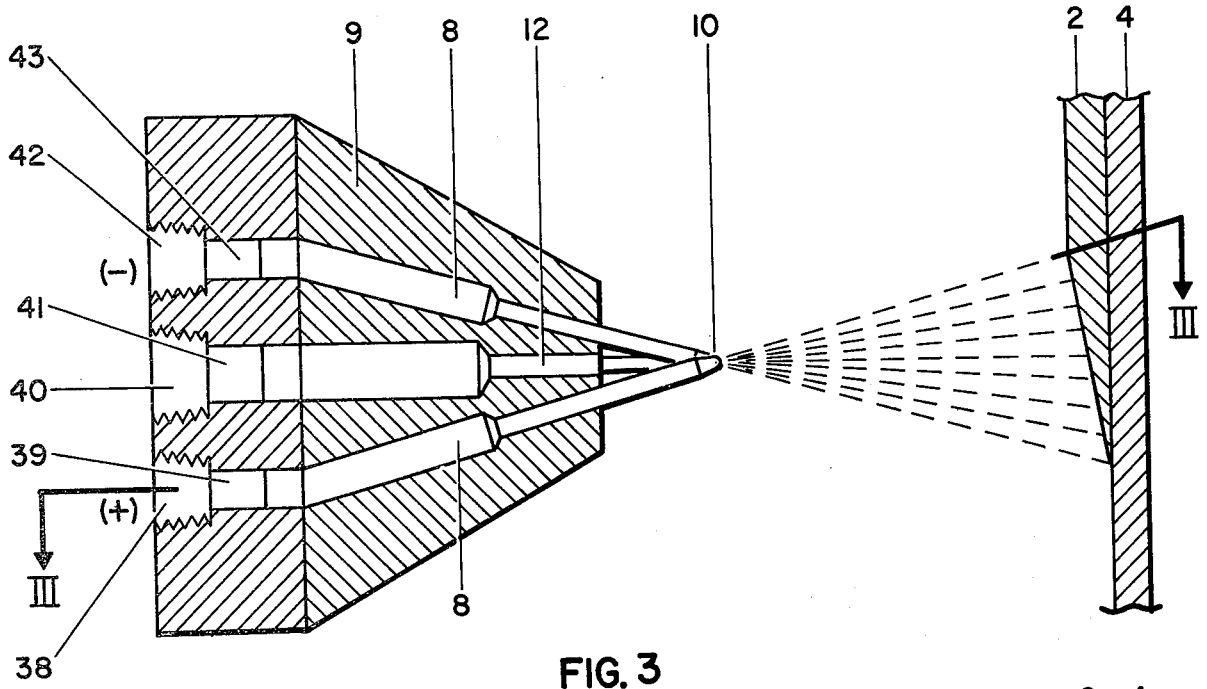
FIG. 2 is a view, in cross section of a coating head embodying the teachings of the invention, taken along lines II of FIG. 3.
Figure 3:
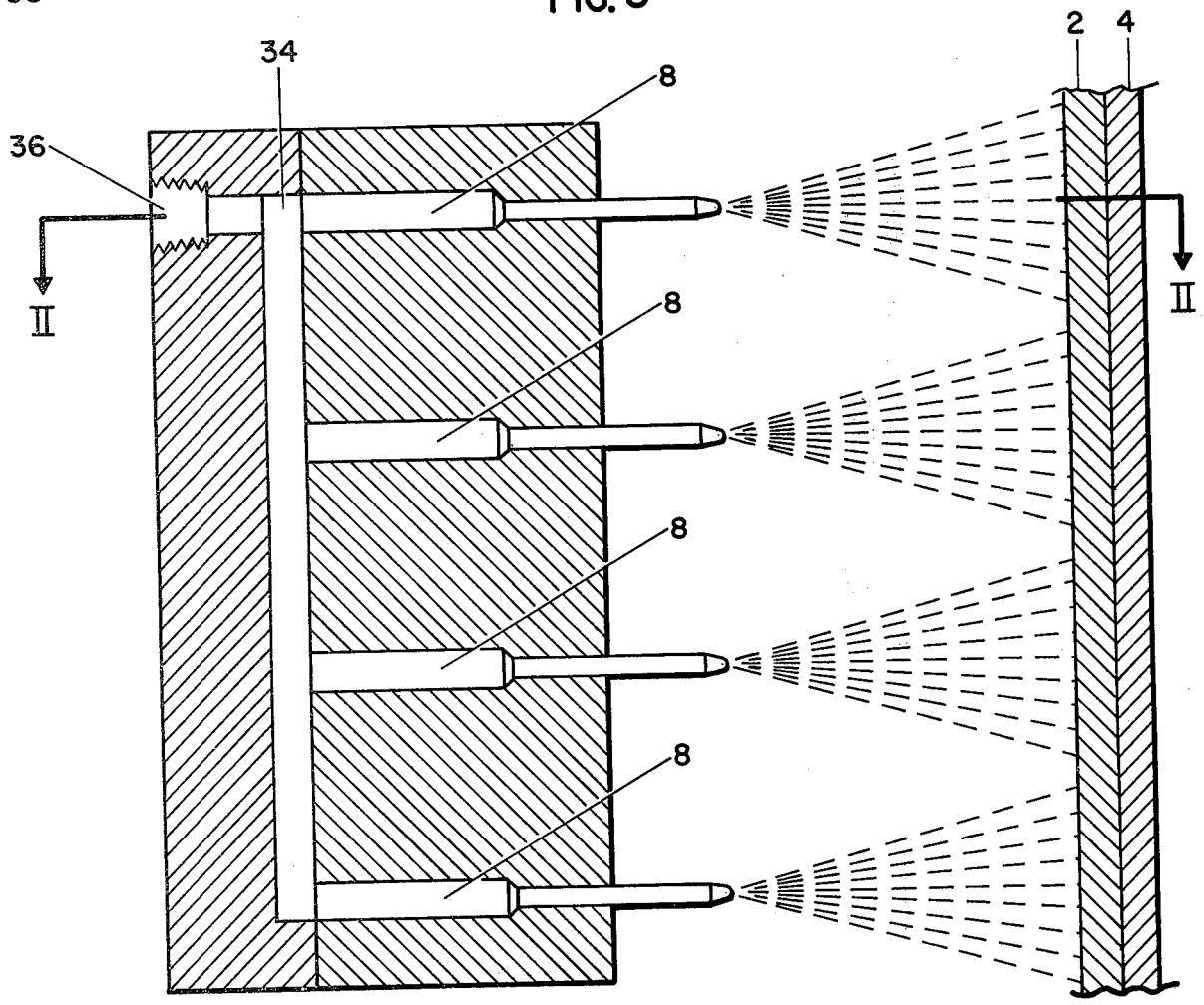
FIG. 3 is a side view of the coating head taken along the lines III of FIG. 2.

FIGS. 2 and 3 illustrate a coating head suitable for use in the practice of the invention. Nozzles 8 for liquid metal and air-jet nozzle 12 are formed in a solid, electrically non-conductive, block 9, as by drilling. Materials useful for the body of block 9 are ceramics, for example, such as aluminum oxide, and the like. The channels forming a pair of nozzles 8 are aimed at convergence point 10, meeting at an angle of approximately 30. Air-jet nozzle 12 is also centered on point of convergence 10; one such nozzle 12 is provided for each pair of liquid-metal-projecting nozzle 8, being centered therebetween. FIG. 3 illustrates the way in which a series of sets of nozzles is assembled in the same block to provide coverage across the width of a sheet substrate 4. Only one nozzle 8 of a given set can be seen, since the view is from the side. As many sets of liquidmetal-projecting nozzles 8, and air-jet nozzles 12, are used as is required to cover a width of the substrate. As can be seen in FIG. 3, a series of nozzles 8, on one side of the block, is interconnected by a manifold passage 34 which, in turn, is connected to an inlet 36 through which liquid metal is received from the conduit and distributed to the nozzles. A similar connection 38 is provided to a like manifold 39, on the other side of the coating head, while air is supplied to still another manifold 41, lying in the plane of symmetry of the coating head, through the connecting aperture 40. These connections are shown, in an end view, in FIG. 2.

The process of the invention which, it will be understood, can be used to coat a variety of metals on a variety of substrates, will be described in connection with the application of a zinc coating upon a steel substrate.

Prior to actually moving the substrate through the coating zone, the surface of the metal should be cleaned of all surface contamination such as oil, moisture, dirt, oxides, mill scale, etc. Suitable surface preparation includes degreasing in hydrocarbon or in perclorethylene or triclorethylene, followed either by grit blasting, surface abrasion, or a deep chemical etch. For best results, surfaces with re-entrant angular cuts on the surface of the substrate produce the best adhesion of a metallized coating. Thus, grit blasting by angular particles of aluminum oxide, chilled cast iron, or crushed copper slag can be used, being considered superior for this purpose to shot blasting. Surface abrasion may be accomplished by the so-called "roto peen" process in which carbide particles, embedded in steel, abrade the surface of the metal. Again, a deep chemical etch or pickle which etchs into the surface grain structure of the metal may be effected by use of solutions of sulphuric acid or the like.

The sheet metal, after cleaning, is then moved through the coating zone at a speed of up to 300 feet per minute. It will be understood by those skilled in the art that the rate of coverage of the surface area will be a function of the linear speed of the steel substrate past the coating zone and the rate of deposit produced by the molten zinc arc spray.

The temperature of molten zinc stored in the containers and pumped up to the point of the arc is desirably kept as close as possible to the melting point of zinc, 419.5° C. Zinc being expelled from the arc will be in a superheated state, having a temperature of approximately 4000° C. While it is not essential to the practice of the invention, it also desirable to preheat and/or post heat the steel surface being coated to a temperature of between 200° C. and 400° C.

A useful range of gas pressure delivered to the nozzle is 60 p.s.i. to 150 p.s.i. of air. The flow rate of gas from the nozzle at a pressure of 80 p.s.i. should be approximately 25 cubic feet per minute.

The range of useful spray rates for zinc through the apparatus described is from a few pounds per hour to several hundred pounds per hour. The actual spray rate depends, of course, on the thickness desired as well as the linear speed of the steel substrate being coated. The range of coating thickness which can be practically achieved is from about 0.001 inches to any desired thickness. The distance between the arc point and the surface of the substrate being coated will vary between 1 inch and 10 inches, depending upon the circumstances and variables described above.

It will be understood by those skilled in the art that the molten metal arc spray apparatus and method for coating substrate by means of a molten metal arc spray, described above, will have a variety of applications to a variety of coating metals and substrates. It is therefore intended that the below appended claims be given an interpretation in keeping with the spirit of the invention rather than limited to the specific embodiments described.

What is claimed is:

1. Apparatus for spray metallizing a substrate comprising:

at least two electrically isolated containers for holding molten metal to be sprayed;

a pair of nozzles for causing two streams of molten metal to converge at a point adjacent to the surface to be metallized;

a spray nozzle behind the point of convergence of the two streams for supplying gas to the streams at the point of convergence for propelling the metal from the point of convergence to the surface to be metallized;

conduits for conveying molten metal from the containers to each of the pair of nozzles;

means for causing a molten metal to flow from a container through a conduit to a nozzle; and a power supply for electrifying the streams of molten metal to cause an arc at the point of convergence.

2. The apparatus of claim 1 in which the pair of nozzles for causing the streams to converge is formed in a block of electrically non-conducting material.

3. The apparatus of claim 2 in which the block of electrically non-conducting material is a ceramic.

4. The apparatus of claim 2 in which the spray nozzle is also formed in the block of electrically non-conducting material.

5. The apparatus of claim 1 in which the means for causing the molten metal to flow to a nozzle is a pump.

6. The apparatus of claim 1 in which the means for causing the molten metal to flow to a nozzle is pressure applied to the liquid metal.

7. The apparatus of claim 1 in which each container and the associated conduit is electrically isolated from the other.

8. The apparatus of claim 7 comprising means for connecting the power supply to molten metal in each container.

9. The apparatus of claim 1 in which the power supply comprises a source of DC power.

10. The apparatus of claim 1 wherein the pair of nozzles for causing the streams to converge and the spray nozzle are formed in a block of electrically non-conducting material; wherein the means for causing the molten metal to flow to the nozzles is a pump; wherein there are at least two containers for holding molten metal and a separate conduit for connecting each container to one nozzle of the pair of nozzles and each container and the associated conduit is electrically isolated from the other; and wherein the power supply comprises a source of DC power and means for connecting the power supply to molten metal in each container.

11. The apparatus of claim 1 wherein the substrate is steel; and wherein the molten metal is zinc, aluminum, nickel, stainless steel, or an alloy capable of metallizing the substrate.

12. A method for spray metallizing a substrate which includes the steps of:

melting the metal to be deposited in at least two electrically isolated containers;

propelling first and second streams of the molten metal towards the substrate at a point of convergence adjacent to the substrate; and applying a potential difference between the streams to form an arc whereby superheated particles are deposited on the substrate.

13. The method for spray metallizing of claim 12 including the step of directing a jet of air at the point of convergence and towards the substrate.

14. The method for spraying metallizing of claim 12 including the step of moving the surface of the substrate past the point of convergence to spread the deposited metal in a continuous coating.

15. The method of claim 12 in which the metal to be deposited is melted in separate bodies and conducted, in separate electrified streams, to the point of convergence.

16. The method of claim 12 in which the molten metal is supplied to spray nozzles under pressure.

17. The method of claim 16 in which the molten metal is pumped to each nozzle.

18. The method of claim 12 in which pressure is applied to the molten metal in separate melting containers to propel it towards the nozzles.

19. The method of claim 12 wherein the substrate is steel; and wherein the molten metal is zinc, aluminum, nickel, stainless steel, or an alloy capable of metallizing the substrate.

20. The method of claim 12 wherein the substrate is steel; and wherein the molten metal is zinc.

* * * * *

UNITED STATES PATENT AND TRADEMARK OFFICE

CERTIFICATE OF CORRECTION

PATENT NO. : 4,269,867

DATED : May 26, 1981

INVENTOR(S) : Kenneth J. Altorfer; Daniel R. Marantz

It is certified that error appears in the above-identified patent and that said Letters Patent is hereby corrected as shown below:

In the title page of the issued patent, Column 1, after "[73] Assignee: Texasgulf Inc., Stamford, Conn." insert -- a part interest --.

Signed and Sealed this

*Twenty-seventh* Day of *March 1984*

[SEAL]

*Attest:*

GERALD J. MOSSINGHOFF

*Attesting Officer*

*Commissioner of Patents and Trademarks*